US012668850B1

(12) United States Patent
Kang et al.

(10) Patent No.: US 12,668,850 B1
(45) Date of Patent: Jun. 30, 2026

(54) METHODS FOR PRODUCING LOCALLY HARDENED COMPONENTS

(71) Applicant: SOUTHWEST TECHNOLOGY AND ENGINEERING RESEARCH INSTITUTE, Chongqing (CN)

(72) Inventors: Feng Kang, Chongqing (CN); Qiang Chen, Chongqing (CN); Yi Che, Chongqing (CN); Feiyue Zhang, Chongqing (CN); Jun Lin, Chongqing (CN); Yanbin Wang, Chongqing (CN); Jun Liu, Chongqing (CN); Feifei Peng, Chongqing (CN)

(73) Assignee: SOUTHWEST TECHNOLOGY AND ENGINEERING RESEARCH INSTITUTE, Chongqing (CN)

( * ) Notice: Subject to any disclaimer, the term of this patent is extended or adjusted under 35 U.S.C. 154(b) by 0 days.

(21) Appl. No.: 19/344,911

(22) Filed: Sep. 30, 2025

(30) Foreign Application Priority Data

Dec. 30, 2024 (CN) ..... 202411968862.3

(51) Int. Cl.
*C21D 1/10* (2006.01)
*C21D 1/60* (2006.01)
*C23C 24/10* (2006.01)

(52) U.S. Cl.
CPC ..... *C21D 1/10* (2013.01); *C21D 1/60* (2013.01); *C23C 24/103* (2013.01); *C21D 2261/00* (2013.01)

(58) Field of Classification Search
CPC ..... C21D 1/10
See application file for complete search history.

(56) References Cited

U.S. PATENT DOCUMENTS

| | | | |
|---|---|---|---|
| 5,081,760 A | 1/1992 | Kikuhara et al. | |
| 2019/0119798 A1 | 4/2019 | Redmond et al. | |

FOREIGN PATENT DOCUMENTS

| | | | | |
|---|---|---|---|---|
| CN | 101660025 A | | 3/2010 | |
| CN | 108893734 A | * | 11/2018 | ..... C23C 8/00 |
| CN | 110306012 A | | 10/2019 | |
| CN | 115058564 A | | 9/2022 | |
| CN | 117107167 A | | 11/2023 | |
| CN | 117187497 A | | 12/2023 | |

OTHER PUBLICATIONS

English machine translation of CN 108893734 A of Liu (Year: 2018).*

* cited by examiner

*Primary Examiner* — Jophy S. Koshy
(74) *Attorney, Agent, or Firm* — Porus IP LLC

(57) ABSTRACT

A method for producing a locally hardened component is provided. The method includes S1: placing a to-be-heated portion of a base component in an induction coil for induction heating to form a heated portion; S2: after a completion of the induction heating, spraying a quenching solution on the heated portion, cooling the heated portion down to room temperature, removing the base component, and tempering the base component at low temperature to obtain a quenched component; and S3: grinding, degreasing, and drying a hardened portion of the quenched component, coating a surface treatment solution on a surface of the hardened portion, curing the surface treatment solution, and performing an induction cladding on the hardened portion in a nitrogen atmosphere to obtain the locally hardened component.

15 Claims, 2 Drawing Sheets

METHODS FOR PRODUCING LOCALLY HARDENED COMPONENTS

CROSS-REFERENCE TO RELATED APPLICATIONS

This application claims priority to Chinese patent application No. 202411968862.3, filed on Dec. 30, 2024, the contents of which are incorporated herein by reference.

TECHNICAL FIELD

The present disclosure relates to the field of heat treatment technology, and in particular, to a method for producing a locally hardened component.

BACKGROUND

Quenching is a common process operation for metal components, which can significantly improve the hardness, strength, and fatigue life of metal materials. The heating processes for quenching include furnace heating and induction heating. Induction heating is widely used in the heating process of quenching due to its high heating efficiency, precise temperature control, and pollution-free heating.

Shaft components are key parts in mechanical transmission, and their comprehensive performance is critical. Different regions require different mechanical properties, such as high hardness in certain regions under high stress, which can be met by local quenching processes. However, for certain complex shaft components such as crankshafts, which have intricate shapes, traditional processes use gas-fired hot nozzles for local high-temperature ablation heating, but gas heating has difficulties in temperature control, severe oxidation, low efficiency, and inconvenient operation. The induction heating, due to shape limitations, results in uneven heating of components, which easily leads to excessive local stress and the formation of cracks, failing to meet the requirements.

In summary, in order to solve the above problems, it is of great significance to provide a method for producing a locally hardened component that can prevent cracking.

SUMMARY

The purpose of the present disclosure is to provide a method for producing a locally hardened component to solve the problems raised in the prior art.

In order to realize the above purpose, the present disclosure provides the following technical solution:

One or more embodiments of the present disclosure provide a method for producing a locally hardened component comprising: S1: placing a to-be-heated portion of a base component in an induction coil for induction heating to form a heated portion; S2: after a completion of the induction heating, spraying a quenching solution on the heated portion, cooling the heated portion down to room temperature, removing the base component, and tempering the base component at low temperature to obtain a quenched component; and S3: grinding, degreasing, and drying a hardened portion of the quenched component, coating a surface treatment solution on a surface of the hardened portion, curing the surface treatment solution, and performing an induction cladding on the hardened portion in a nitrogen atmosphere to obtain the locally hardened component.

BRIEF DESCRIPTION OF THE DRAWINGS

The present disclosure will be further illustrated by way of exemplary embodiments, which will be described in detail by means of the accompanying drawings. These embodiments are not limiting, and in these embodiments, the same numbering denotes the same structure, wherein.

DETAILED DESCRIPTION

Based on the embodiments in the present disclosure, all other embodiments obtained by a person of ordinary skill in the art without making creative labor fall within the scope of protection of the present disclosure.

It should be noted that all raw materials involved in this application are purchased from manufacturers without any special limitations. For example, the raw materials include: triethanolamine, monoethanolamine, calcium chloride, sorbitan monooleate, ethylene oxide, propylene oxide, glycidic acid, dopamine, tungsten powder with a particle size in a range of 1~4 μm, and nickel powder with a particle size in a range of 1~4 μm. In the following embodiments, the parts refer to parts by mass (or the ratio refers to a mass ratio), and the raw materials are all commercially available.

The crankshaft in each embodiment includes the following elements, by mass fraction: C: 0.46%, Si: 0.25%, Mn: 1.16%, P: 0.01%, S: 0.012%, Cr: 0.17%, V: 0.07%, Ni: 0.01%, Cu: 0.1%, Mo: 0.01%, Ti: 0.016%, and the rest are Fe and other unavoidable impurities; at the same time, the quenching temperature of the crankshaft is in a range of 840~860° C.

The quenching solution in each embodiment includes the following substances in parts by mass: 30 parts of modified PAG copolymer, 0.35 parts of triethanolamine, 0.05 parts of monoethanolamine, 3 parts of calcium chloride, 2 parts of sorbitan monooleate, and 35 parts of deionized water. The quenching solution needs to be diluted three times with water before use.

In some embodiments, a method for producing a locally hardened component includes the following operations.

In S1, a to-be-heated portion of a base component is placed in an induction coil for induction heating to form a heated portion.

The base component is an original metal workpiece to be treated. In some embodiments, the base component may include, but is not limited to, a bearing, a cutter, a mold, a guide rail, a blade, or the like. The base component may be determined based on actual production scenarios and needs.

The induction coil is a heating element used for induction heating.

Figure 1:
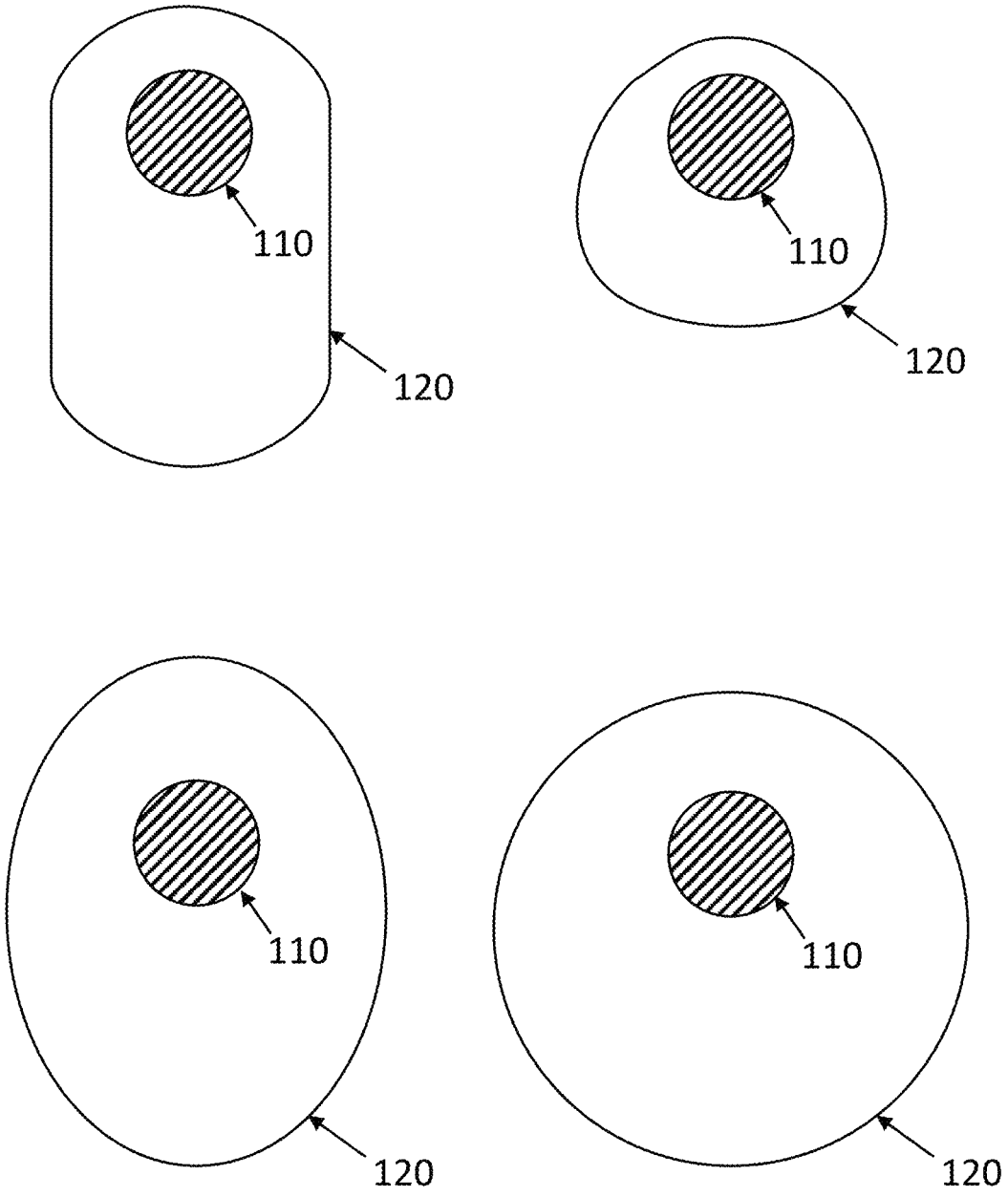
FIG. 1 is an exemplary schematic diagram of induction heating according to some embodiments of the present disclosure.

FIG. 1 is an exemplary schematic diagram of induction heating according to some embodiments of the present disclosure. As shown in FIG. 1, an induction coil 120 may include a variety of shapes, such as a circle, an oval, a pear-like shape, or other shapes. A base component 110 is placed inside the induction coil 120, and the induction coil 120 may perform non-contact heating on the base component 110 by electromagnetic induction.

In some embodiments, the heating manner and heating temperature of the induction coil may be determined according to the actual production scenarios and needs. For example, the induction coil may uniformly heat a to-be-heated portion (i.e., a portion to be heated). As another example, the induction coil may perform a gradient heating on the to-be-heated portion.

Figure 2:
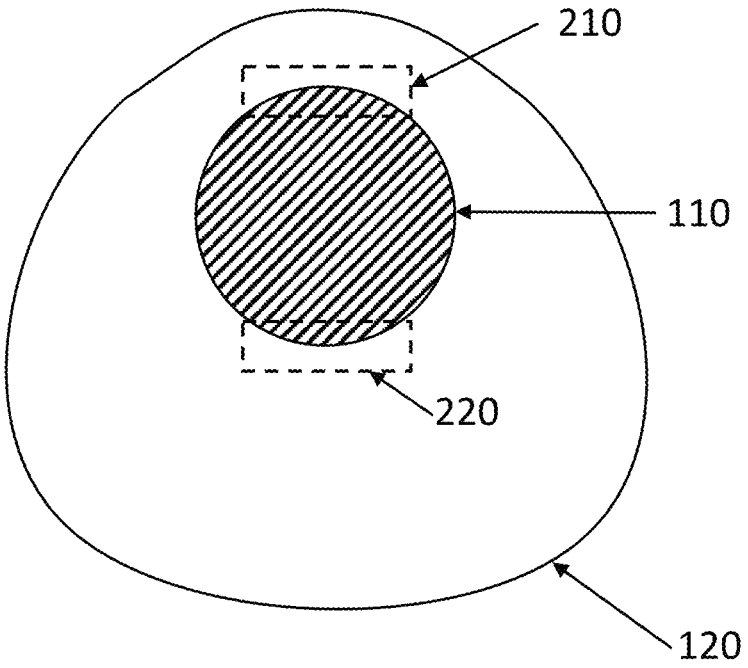
FIG. 2 is an exemplary schematic diagram of gradient heating according to some embodiments of the present disclosure.

FIG. 2 is an exemplary schematic diagram of gradient heating according to some embodiments of the present disclosure.

In some embodiments, in operation S1, the induction heating is gradient heating. A first heating temperature and a second heating temperature are formed in a cross-section of the to-be-heated portion of the base component. During the induction heating, the first heating temperature is equal to a component quenching temperature +50° C., and the second heating temperature is equal to the component quenching temperature ±10° C.

The gradient heating is a type of non-uniform heating method. The gradient heating creates a continuous temperature distribution from a high temperature to a low temperature in the cross-section of the to-be-heated portion.

In some embodiments, as shown in FIG. 2, the cross-section of the base component 110 produces the first heating temperature and the second heating temperature. The first heating temperature is the maximum temperature during the gradient heating, and the second heating temperature is the minimum temperature during the gradient heating.

In some embodiments, since the cross-section of the base component 110 has a higher temperature at a location closer to the induction coil (a proximal region 210 in FIG. 2) and a lower temperature at a location far away from the induction coil (a distal region 220 in FIG. 2), a heating temperature of a region 210 may be the first heating temperature, and a heating temperature of a region 220 may be the second heating temperature.

The component quenching temperature refers to a preset quenching temperature. The component quenching temperature may be determined according to the actual production scenarios and demands.

In some embodiments, the first heating temperature may be equal to the component quenching temperature +55° C. In some embodiments, the first heating temperature may be equal to the component quenching temperature +60° C. In some embodiments, the first heating temperature may be equal to the component quenching temperature +45° C. In some embodiments, the first heating temperature may be equal to the component quenching temperature +40° C.

In some embodiments, the second heating temperature may be equal to the component quenching temperature ±5° C. In some embodiments, the second heating temperature may be equal to the component quenching temperature ±2° C. In some embodiments, the second heating temperature may be equal to the component quenching temperature ±1° C. In some embodiments, the second heating temperature may be equal to the component quenching temperature.

In some embodiments, switching between uniform heating and gradient heating may be achieved by changing a positional relationship between the induction coil 120 and the base component 110. For example, when the induction coil 120 is a circular coil, and the geometric center of the base component 110 coincides with the geometric center of the induction coil 120, the base component 110 is at the same distance from the induction coil in cross-section, and the induction coil 120 may provide uniform heating to the base component 110. When the geometric center of the base component 110 is offset from the geometric center of the induction coil 120, the base component 110 has a proximal region and a distal region in the cross-section, and the induction coil 120 may provide gradient heating to the base component 110.

By adopting the solution provided in the present disclosure, it is possible to conveniently and accurately adopt a localized heating manner to heat a specified part of the component, thereby improving the corresponding performance of the part that requires heat treatment, while the performance of the parts that do not participate in heat treatment remains unchanged, and due to the heating time is short, the internal grain size may not grow, and there is less oxide scale, resulting in good surface quality. The components subjected to surface heat treatment using this localized heating manner have the advantages of high hardness in designated parts, fine internal structure, small heating device volume, and low energy consumption. Using the localized heating manner, it has the features of strong operability and low cost, and is suitable for large-scale production. Meanwhile, the present disclosure adopts the induction coil for the gradient heating, the induction coil is at different distances from the two ends of the cross-section of the base component, and there exists a temperature gradient in the cross-section of the base component; the closer the distance to the induction coil, the greater the magnetic field density, and the higher the temperature; the farther away from the induction coil, the smaller the magnetic field density, the lower the temperature. In addition, the present disclosure controls the proximal temperature to be equal to the component quenching temperature +50° C., and the second heating temperature to be equal to the component quenching temperature +10° C., which helps to improve the efficiency of the induction heating, enabling the component to reach the quenching temperature quickly, and can also meet the centralized local heating requirements of some complex components, providing better flexibility.

In S2, after the completion of the induction heating, a quenching solution is sprayed on the heated portion, the heated portion is cooled down to room temperature, the base component is removed, and the base component is low-temperature tempered to obtain a quenched component.

The low-temperature tempering refers to a process in which the base component after quenching is heated, insulated, and slowly cooled. The process of low-temperature tempering may relieve the internal stresses generated by rapid cooling during the quenching process, reduce the brittleness of the component, and prevent the component from cracking in subsequent processing or use.

The duration and temperature of the low-temperature tempering may be determined according to actual production scenarios and needs. For example, the temperature of the low temperature tempering may be in a range of 100° C. to 250° C., and the length of the low temperature tempering may be in a range of 2 h to 3 h.

The quenching solution is a solution that is used to rapidly cool the heated portion. The quenching solution can control the cooling rate and cause a martensitic phase change in the heated portion, thereby improving the hardness and abrasion resistance of the component.

In some embodiments, the composition of the quenching solution may be determined based on actual production scenarios and needs.

In some embodiments, the quenching solution includes substances including: modified polyalkylene glycol (PAG) copolymer, triethanolamine, monoethanolamine, calcium chloride, sorbitan monooleate, and deionized water in a mass ratio of (30~35):(0.3~0.4):(0.05~0.1):(2.5~3.5):(1~3):(35~40).

In some embodiments, the parts by mass of the modified PAG copolymer may also be one of 30 parts, 31 parts, 32 parts, 33 parts, 34 parts, or 35 parts; the parts by mass of triethanolamine may also be 0.3 parts, 0.35 parts, or 0.4 parts; the parts by mass of monoethanolamine may also be 0.05 parts, 0.075 parts, or 0.1 parts; the parts by mass of calcium chloride may also be 2.5 parts, 3 parts, or 3.5 parts; the parts by mass of sorbitan monooleate may also be 1 part, 2 parts, or 3 parts; the parts by mass of deionized water may also be one of 35 parts, 36 parts, 37 parts, 38 parts, 39 parts, or 40 parts.

The modified PAG copolymer is a polymer material for controlling the cooling rate, and the modified PAG copolymer may be obtained by modifying the activation of the PAG copolymer.

In some embodiments, the manner of preparing the modified PAG copolymer includes the following operations.

(1) A polymerized monomer is obtained by mixing ethylene oxide, propylene oxide, and glycidic acid at a temperature of 3~5° C.

(2) Under a nitrogen atmosphere, propylene glycol and catalyst are added to a reactor, and the reactor is heated to 75~85° C. under a vacuum degree≤−0.09 MPa, after which the polymerized monomer is gradually introduced in to ensure that a pressure is 50.3 MPa, and a reaction is carried out at 125~135° C. for 8~10 h, and after purification, a PAG copolymer is obtained.

In some embodiments, the vacuum degree may also be one of ≤−0.09 MPa, ≤−0.095 MPa, or ≤−0.1 MPa; the heating temperature may also be one of 75° C., 76° C., 77° C., 78° C., 79° C., 80° C., 81° C., 82° C., 83° C., 84° C., or 85° C.; the pressure may also be one of 50.3 MPa, 50.25 MPa, 50.2 MPa, 50.15 MPa, or 50.1 MPa; the reaction temperature may also be one of 125° C., 126° C., 127° C., 128° C., 129° C., 130° C., 131° C., 132° C., 133° C., 134° C., or 135° C.; the reaction duration may also be one of 8 h, 8.5 h, 9 h, 9.5 h, or 10 h.

The manner of purification and the composition of the catalyst may be determined according to actual production scenarios and needs. For example, the purification may be carried out by a process such as recrystallization, liquid separation and extraction, adsorption purification, chromatographic purification, or the like.

In some embodiments, the catalyst includes a diimine iron complex and a potassium hydroxide. For example, the diimine iron complex and the potassium hydroxide are in a mass ratio of 1:3.5.

(3) The PAG copolymer is added to deionized water and mixed, and chitosan and an activator are added and stirred at 80~85° C. for 5~6 h. After purification and drying, the modified PAG copolymer is obtained.

The activator is a chemical additive used for modification. The activator may promote the grafting reaction between the chitosan and the PAG copolymer, and enhance the hydrophilicity and adsorption properties of the PAG copolymer.

In some embodiments, the activator includes 1-(3-dimethylaminopropyl)-3-ethylcarbodiimide and succinimide in a mass ratio of 1:1~3.

In some embodiments, the proportions of the raw materials in the modified PAG copolymer may be determined based on actual production scenarios and needs.

In some embodiments, the polymerized monomer includes the ethylene oxide, the propylene oxide, and the glycidic acid in a mass ratio of 10:(13~14):(3~5); a mass ratio of the propylene glycol and the catalyst is (5~7):1; a mass ratio of the polymerized monomer and the catalyst is 100:(0.5~0.7); and the modified PAG copolymer includes raw materials including: the PAG copolymer, the deionized water, the chitosan, the activator in a mass ration of (8~10):(40~50):(3~5):(3~4).

In some embodiments, the mass ratio of ethylene oxide, propylene oxide, and glycidic acid may also be one of 10:13:3, 10:13:4, 10:13:5, 10:14:3, 10:14:4, or 10:14:5; the mass ratio of the propylene glycol and the catalyst may also be one of 5:1, 6:1, or 7:1; the mass ratio of the polymerized monomer and the catalyst is one of 100:0.5, 100:0.6, or 100:0.7; the parts by mass of the PAG copolymer is one of 8 parts, 9 parts, or 10 parts; the parts by mass of the deionized water is one of 45 parts, 46 parts, 47 parts, 48 parts, 49 parts, or 50 parts; the parts by mass of the chitosan is one of 3 parts, 4 parts, or 5 parts; and the parts by mass of the activator is one of 3 parts, 3.5 parts, or 4 parts.

In some embodiments of the present disclosure, by mixing at a low temperature of 3~5° C., pre-polymerization of epoxy monomers can be avoided at the mixing stage to ensure that the monomers are uniformly dispersed; the catalytic synthesis through nitrogen atmosphere and vacuum pretreatment can prevent catalyst deactivation and side reactions such as oxidation; by preheating and introducing monomers, combined with pressure control and reaction temperature regulation to generate the PAG copolymer, the gradual ring-opening polymerization of epoxy monomers can be achieved, reducing the occurrence of side reactions such as chain transfer reactions and improving the uniformity of the molecular weight distribution of PAG copolymers; by subsequent modification with the chitosan under the action of the activator, the hydrophilicity and adsorption capacity of the PAG copolymer can be enhanced, ensuring that the final modified PAG copolymer has excellent film-forming property and sufficient adhesion to the component.

This present disclosure uses the aqueous polymer PAG as the quenching medium. Due to the inverse solubility of the aqueous polymer PAG, the solubility of the aqueous polymer PAG decreases with increasing temperature at 70~88° C., and the polymer may precipitate and adhere to the surface of the component to form a layer of organic film, thereby regulating the cooling rate of temperature. Controlling the cooling rate of the component when it reaches the Ms point (the temperature at which martensite begins to transform) can solve the problem of cracking and deformation caused by rapid cooling of water in a low-temperature region. However, the film generated based on the PAG copolymer in the low-temperature region is discontinuous and has lower strength. The cooling rate at the Ms point is between that of water and oil, so in the present disclosure, by grafting the chitosan onto the PAG copolymer, due to the chitosan has a good film-forming effect, it is possible to compensate for the rapid and uneven cooling caused by the discontinuous film generated by PAG in the low-temperature region, reducing the possibility of component cracking.

In some embodiments, the quenching solution may be used after triple dilution with water.

The water pressure and water flow density for spraying the quenching solution may be determined based on actual production scenarios and needs.

In some embodiments, the water pressure for spraying the quenching solution in operation S2 is in a range of 100 to 120 kPa, and the water flow density is in a range of 70 to 80 $L \cdot m^{-2}s^{-1}$.

In some embodiments, the water pressure for spraying the quenching solution may also be one of 100 kPa, 105 kPa, 110 kPa, 115 kPa, or 120 kPa.

In some embodiments, the water pressure for spraying the quenching solution may also be one of 100~105 kPa, 100~110 kPa, 100~115 kPa, 100~120 kPa, 105~110 kPa, 105~115 kPa, 105~120 kPa, 110~115 kPa, 110~120 kPa, or 115~120 kPa.

In some embodiments, the water flow density for spraying the quenching solution may also be one of 70 $L \cdot m^{-2}s^{-1}$, 72 $L \cdot m^{-2}s^{-1}$, 75 $L \cdot m^{-2}s^{-1}$, 78 $L \cdot m^{-2}s^{-1}$, or 80 $L \cdot m^{-2}s^{-1}$.

In some embodiments, the water flow density for spraying the quenching solution may also be one of 70~72 $L \cdot m^{-2}s^{-1}$, 70~75 $L \cdot m^{-2}s^{-1}$, 70~78 $L \cdot m^{-2}s^{-1}$, 75~80 $L \cdot m^{-2}s^{-1}$, or 72~75 $L \cdot m^{-2}s^{-1}$.

In some embodiments of the present disclosure, by setting the water pressure for spraying the quenching solution to be in a range of 100~120 kPa and the water flow density to be in a range of 70~80 $L \cdot m^{-2}s^{-1}$, it can ensure stable and uniform cooling of the basic component, thereby reducing the risk of quenching deformation and cracking.

In S3, a hardened portion of the quenched component is ground, degreased, and dried, a surface treatment solution is coated on a surface of the hardened portion, the surface treatment solution is cured, and an induction cladding is performed on the hardened portion in a nitrogen atmosphere to obtain the locally hardened component.

The hardened portion refers to a region of the base component where the hardness is significantly increased after quenching treatment.

In some embodiments, due to the possibility of residual quenching solution and other contaminants on the surface of the hardened portion after quenching, the hardened portion may be pre-cleaned for subsequent operations.

In some embodiments, the pre-cleaning may include, but is not limited to, grinding, degreasing, and drying, so as to remove surface oxidized layers, oils, residual quenching solution, and other contaminants on the hardened portion.

In some embodiments, after cleaning is completed on the hardened portion, a surface treatment solution may be applied to the surface of the hardened portion and cured.

The surface treatment solution is a treatment fluid that is applied to the surface of the hardened portion. The surface treatment solution may be metallurgically bonded with the quenched component during the induction cladding process to enhance the wear and corrosion resistance of the surface of the hardened portion. The raw materials of the surface treatment solution and ratios of the raw materials may be determined according to the actual production scenarios and needs.

In some embodiments, the surface treatment solution is prepared based on the following operations.

(1) Sodium polymethacrylate is added to deionized water and mixed, dopamine and an activator (same as the activator in modified PAG copolymer preparation) are added, pH is adjusted to 7.5~8.5, the adjusted solution is heated and stirred at 70~80° C. for 5~7 h, and modified polymethacrylic acid is obtained after liquid separation and washing.

The modified polymethacrylic acid is a polymer that has been modified. The modified polymethacrylic acid has higher surface binding properties compared to polymethacrylic acid.

In some embodiments, the modified polymethacrylic acid may be modified by dopamine and the activator. More descriptions of the activator may be found in the above descriptions.

In some embodiments, the modified polymethacrylic acid includes the sodium polymethacrylate, the dopamine, and the activator in a mass ratio of (4~5):(14~16):(7~8).

In some embodiments, the parts by mass of the sodium polymethacrylate may also be one of 4 parts, 4.5 parts, or 5 parts; the parts by mass of the dopamine may also be one of 14 parts, 15 parts, or 16 parts; and the parts by mass of the activator may also be one of 7 parts, 7.5 parts, or 8 parts.

In some embodiments, the sodium polymethacrylate has a molecular weight of 3000~4000.

According to some embodiments of the present disclosure, by setting the modified polymethacrylic acid to include the sodium polymethacrylate, the dopamine, and the activator in the mass ratio of (4~5):(14~16):(7~8), it can ensure that the dopamine sufficiently performs the modification grafting on the polymethacrylic acid and enhances affinity of the polymethacrylic acid to the metal powder, thereby more effectively dispersing the metal powder in the surface treatment solution.

According to some embodiments of the present disclosure, by setting the sodium polymethacrylate to have the molecular weight of 3000~4000, the water solubility and the film-forming property of the polymethacrylic acid may be balanced, avoiding insufficient coating strength caused by low molecular weight or high viscosity caused by high molecular weight.

(2) Metal powder is obtained by mixing nano titanium carbide, tungsten powder, and nickel powder.

The mass ratio and particle size of nano titanium carbide, tungsten powder, and nickel powder may be determined according to the actual production scenarios and needs.

In some embodiments, the metal powder includes the nano titanium carbide, the tungsten powder, and the nickel powder in a mass ratio of 2:(3~4):(5~6).

In some embodiments, the mass ratio of the nano titanium carbide, tungsten powder, and nickel powder may also be one of 2:3:5, 2:3.5:5.5, 2:4:6, 2:3:5.5, 2:3.5:6, or 2:4:5.5.

In some embodiments of the present disclosure, by setting the nano titanium carbide, the tungsten powder, the nickel powder to be in the mass ratio of 2:(3~4):(5~6), the proportion of titanium carbide with high hardness, tungsten with good wear resistance, and nickel with good bonding performance in the metal powder can be balanced to ensure that the locally hardened component combines high hardness and high toughness.

In some embodiments, the tungsten powder and the nickel powder have a particle size of 1-4 μm.

According to some embodiments of the present disclosure, by setting the tungsten powder and the nickel powder to have the particle size of 1-4 μm, it is possible to ensure a uniform dispersion of the metal powders in the surface treatment solution, avoid coating defects caused by large particles, and at the same time enhance the melting efficiency during the melting.

(3) The metal powder, the modified polymethacrylic acid, ethyl cellulose, and acetone are mixed, and the mixture is shear stirred at 40~45° C. for 1~1.5 h to obtain the surface treatment solution.

In some embodiments, the surface treatment solution comprises the metal powder, the modified polymethacrylic acid, the ethyl cellulose, and the acetone in a mass ratio of 3:(1~2):(2.5~3.5):(24~26).

In some embodiments, the mass ratio of the metal powder, modified polymethacrylic acid, ethyl cellulose, and acetone may also be 3:1:2.5:24, 3:1.5:3:25, 3:2:3.5:26, 3:1:3:25.5, 3:2:2.5:24.5, or 3:1.5:3.5:25.

According to some embodiments of the present disclosure, by setting the surface treatment solution to include the metal powder, the modified polymethacrylic acid, the ethyl cellulose, and the acetone in a mass ratio of 3:(1~2):(2.5~3.5):(24~26), it is possible to ensure that the solid content and solvent have a suitable ratio, so that the surface treatment solution has both good flowability and high solid content to form a uniform thin film.

In order to further improve the hardness of the hardened portion, the surface treatment solution containing metal powder is coated on the surface of the hardened portion, which is cured and then induction cladding to form a hardened layer on the surface, thereby improving the hardness, wear resistance, and corrosion resistance of the material. Meanwhile, since the present disclosure only requires coating on the parts that need to be hardened and using induction cladding, the operation is convenient, the heating time is short, and it is possible to locally harden the complex component without causing significant impact on the surface of the component that has already been quenched. Due to the viscous nature of the surface treatment solution, it is difficult for the metal powder to be stably dispersed in the system. Therefore, this present disclosure modifies and grafts dopamine onto the polymethacrylic acid. The catechol groups of the dopamine have a good attraction to the metal, allowing the metal particles to be uniformly loaded on the polymethacrylic acid, thereby improving the dispersibility of the metal powder. The excess catechol groups can combine with the surface metal of the component, improving the tightness between the surface treatment solution and the component and facilitating subsequent operations.

In some embodiments, the coating thickness of the surface treatment solution may be determined based on actual production scenarios and needs.

In some embodiments, in operation S3, the coating thickness of the surface treatment solution is in a range of 0.5~0.7 mm.

In some embodiments, in operation S3, the coating thickness of the surface treatment solution may be one of 0.5, 0.55, 0.6, 0.65, or 0.7 mm.

In some embodiments, in operation S3, the coating thickness of the surface treatment solution may further be one of 0.5~0.55 mm, 0.5~0.6 mm, 0.5~0.65 mm, 0.55~0.7 mm, 0.55~0.6 mm, or 0.55~0.65 mm.

In some embodiments, in operation S3, the surface treatment solution may be cured in a variety of ways, such as air-drying curing, heating curing, or the like.

In some embodiments, in operation S3, the temperature for curing the surface treatment solution is in a range of 140~150° C., and the time for curing the surface treatment solution is in a range of 5~10 min.

In some embodiments, the temperature for curing the surface treatment solution may further be one of 140, 142, 145, 148, or 150° C., and the time for curing the surface treatment solution may further be one of 5, 6, 7, 8, 9, or 10 min.

In some embodiments, the temperature for curing the surface treatment solution may also be one of 140~142° C., 140~145° C., 140~148° C., 142~150° C., 142~145° C., or 142~148° C., and the time for curing the surface treatment solution may also be one of 5~6 min, 5~7 min, 5~8 min, 5~9 min, 6~7 min, 6~8 min, or 6~9 min.

In some embodiments, after the surface treatment solution is cured, the induction cladding may be performed on the hardened portion under a nitrogen atmosphere to obtain a locally hardened component.

The induction cladding is a treatment process for modifying the surface of the hardened portion. The induction cladding may produce eddy currents on the surface of the hardened portion through a high-frequency alternating magnetic field and rapidly heating and melting, causing the cured surface treatment solution to metallurgically bond with the hardened portion, and a locally hardened component is obtained.

In some embodiments, in operation S3, the induction cladding is operated at a current of 1150~1250 A, a power of 25 KW, an oscillation frequency in a range of 50~80 kHz, a coil turn count of 4, and a time of 40~50s.

In some embodiments of the present disclosure, by setting the induction cladding to be operated at the current of 1150~1250 A, the power of 25 kW, the oscillation frequency in the range of 50~80 kHz, the coil turn count of 4, and the time of 40~50s, it is possible to precisely control the heat provided in the cladding process, so as to ensure that the surface treatment solution forms a uniform and high-strength metallurgical bond with the hardened portion, while avoiding excessive heating that can degrade the performance of the component substrate, ultimately improving the surface hardness, wear resistance, and overall mechanical stability of the locally hardened component.

The following are examples of a method for producing a locally hardened component provided by some embodiments of the present disclosure.

Example 1

In S1, the preparation of the surface treatment solution includes the following operations. In S1-1, 4.5 parts by mass of sodium polymethacrylate were added to 50 parts by mass of deionized water and stirred, 15 parts by mass of dopamine and 7.5 parts by mass of an activator were added, pH was adjusted to 8, the mixture was heated and stirred at 45° C. for 6 h, and after liquid separation and washing, the modified polymethacrylic acid was obtained. In S1-2, nano titanium carbide, tungsten powder, and nickel powder were mixed at a mass ratio of 2:3.5:5.5 to obtain metal powder. In S1-3, the metal powder, modified polymethacrylic acid, ethyl cellulose, and acetone were mixed at a mass ratio of 3:1.5:3:25, and the mixture was shear stirred at 40° C. for 1.5 h to obtain the surface treatment solution.

In S2, the preparation of the modified PAG copolymer includes the following operations. In S2-1, ethylene oxide, propylene oxide, and glycidic acid were mixed uniformly at a mass ratio of 10:13.5:4 under a temperature of 4° C. to obtain a polymerized monomer. In S2-2, under a nitrogen atmosphere, propylene glycol and catalyst (i.e., diimine iron complex and potassium hydroxide at a mass ratio of 1:3.5) were added to a reactor at a mass ratio of 6:1, the mixture was heated to 80° C. under a vacuum degree≤−0.09 MPa, then the polymerized monomer was gradually introduced in (mass ratio of polymerized monomer to catalyst was 100:0.6), pressure was ensured to be ≤0.3 MPa, a reaction was reacted at 130° C. for 9 h, and after purification, a PAG copolymer was obtained. In S2-3, 9 parts by mass of PAG copolymer were added to 45 parts by mass of deionized water and stirred, 4 parts by mass of chitosan and 3.5 parts by mass of an activator were added, the mixture was stirred at 80° C. for 5.5 h, after purification and drying, the modified PAG copolymer was obtained, which was subsequently used as a raw material for quenching solution In S3, the local quenching of a complex component includes the following operations. In S3-1, under a nitrogen atmosphere, a to-be-heated portion of a base component was placed in an induction coil, the induction coil was adjusted to cover the shape of the component's to-be-heated portion, and the induction heating was performed at 900° C. for the proximal end and 850° C. for the distal end for 50s to form a heated portion. In S3-2, after the completion of the induction heating, a quenching solution was sprayed on the heated portion at a water pressure of 100 kPa and a water flow density of 75 $L \cdot m^{-2} s^{-1}$, after the heated portion was cooled to room temperature, the heated portion was removed and tempered at 200° C. for 2.5 h, and a quenched component was obtained. In S3-3, the portion to be hardened of the quenched component was ground, degreased, and dried, the surface treatment solution was coated on the surface of the quenched component with a thickness of 0.6 mm, the surface treatment solution was cured at 145° C. for 5 min, and an induction cladding was performed on the hardened portion under a nitrogen atmosphere (parameters for the induction cladding: the current was 1150~1250 A, the power was 25 KW, the oscillation frequency was 50~80 kHz, the coil turn count was 4, the time was 45s) to obtain the locally hardened component.

Example 2

Example 2 provides a method for producing a locally hardened component. The operations for preparing the locally hardened component in example 2 are similar to those of example 1, with the only differences being that in Example 2, the induction heating time in S3-1 is modified to 40s, the water flow density in S3-2 is modified to 70 $L \cdot m^{-2}s^{-1}$, the curing temperature in S3-3 is modified to 140° C., and the induction cladding time in S3-3 is modified to 40s.

Example 3

Example 3 provides a method for producing a locally hardened component. The operations for preparing the locally hardened component in example 3 are similar to those of example 1, with the only differences being that in Example 3, the induction heating time in S3-1 is modified to 60s, the water pressure in S3-2 is modified to 120 kPa, the water flow density in S3-2 is modified to 80 $L \cdot m^{-2}s^{-1}$, the coating thickness of the surface treatment solution in S3-3 is modified to 0.7 mm, the curing temperature in S3-3 is modified to 150° C., the curing time in S3-3 is modified to 10 min, and the induction cladding time in S3-3 is modified to 50s.

Comparative Example 1

Comparative example 1 provides a method for producing a locally hardened component. The operations for preparing the locally hardened component in comparative example 1 are similar to those of example 1, with the difference being that in comparative example 1, the induction heating manner in S3-1 is modified to uniform heating, and the temperature of uniform heating is 850° C.

Comparative Example 2

Comparative example 2 provides a method for producing a locally hardened component. The operations for preparing the locally hardened component in comparative example 2 are similar to those of example 1, with the difference being that in comparative example 2, S2 is omitted. That is, comparative example 2 no longer prepares the modified PAG copolymer to obtain a self-made PAG quenching solution, but directly uses a commercially available PAG quenching solution for the quenching treatment in S3-2.

Comparative Example 3

Comparative example 3 provides a method for producing a locally hardened component. The operations for preparing the locally hardened component in comparative example 3 are similar to those of Example 1, with the difference being that in comparative example 3, S1 and S3-3 are omitted. That is, the final product of comparative example 3 is not subjected to induction cladding treatment, but the quenched component from S3-2 is directly used as the final product.

Comparative Example 4

Comparative example 4 provides a method for producing a locally hardened component. The operations for preparing the locally hardened component in comparative example 4 are similar to those of example 1, with the difference being that in comparative example 4, S1-1 is omitted. That is, comparative example 4 no longer prepares the modified polymethacrylic acid, and in S1-3, unmodified sodium polymethacrylate is mixed with other raw materials to prepare the surface treatment solution.

Performance Test:

(1) According to the document GB/T 5617-2005, the surface hardness of the quenched crankshaft in each embodiment was measured using a surface hardness tester, and the experimental data is shown in Table I. (2) According to the document GB/T 39240-2020, ultrasonic testing of the quenched crankshaft was conducted for each embodiment, and the count of internal cracks in the components was rated as A, B, C, and D (A: no cracks were found on the surface and inside the component; B: a small count of cracks existed in the component; C: a moderate count of cracks existed in the component, but the count was still within an acceptable range; D: a large count of cracks existed in the component, and the structural integrity is low).

TABLE I

| Project | Hardness HRC | Count of cracks |
|---|---|---|
| Example 1 | 60.2 | A |
| Example 2 | 58.7 | A |
| Example 3 | 59.1 | A |
| Comparative example 1 | 54.2 | B− |
| Comparative example 2 | 53.5 | B |
| Comparative example 3 | 48.2 | B+ |
| Comparative example 4 | 50.1 | B |

As can be seen from Table I, compared to the gradient heating in this present disclosure, comparative example 1, which adopts a circular coil for the uniform heating, has a slower heating rate, a decrease in the strength of the hardened portion, and the strength of the hardened portion is lower than that in example 1. Comparative example 2 uses a commercially available PAG quenching solution, resulting in a discontinuous film with low strength. The temperature drops rapidly at the Ms point, leading to the formation of microcracks, and the hardness is lower than that in example 1. Comparative example 3, without applying the surface treatment solution or performing the induction cladding, has a local quenching hardness lower than the hardness of the hardened layer in example 1. In comparative example 4, the sodium polymethacrylate is used as the raw material for the surface treatment solution instead of the modified polymethacrylic acid, resulting in poor dispersibility of metal powder in the system, agglomeration after induction cladding, and a decrease in hardness.

CONCLUSION

This application uses the induction coil for gradient heating, and uses the chitosan-modified PAG quenching solution for quenching, as well as performs the induction cladding to harden the layer after coating the surface treatment solution, which successfully provides the method for producing a locally hardened component that can prevent cracking and result in higher hardness in the hardened portion of the final product.

Lastly, it should be noted that the above is only a preferred embodiment of the present disclosure, and is not intended to limit the present disclosure, and although the present disclosure has been described in detail with reference to the foregoing embodiments, the technical program may be modified by the technical personnel in the field with respect to the foregoing embodiments. Although the present disclosure is described in detail with reference to the foregoing embodiments, a person skilled in the art may still modify the technical solutions recorded in the foregoing embodiments, or replace some of the technical features with equivalent ones. Any modifications, equivalent substitutions, improvements, etc. made within the spirit and principles of this application shall be included in the scope of protection of this application.

What is claimed is:

1. A method for producing a locally hardened component, comprising:

S1: placing a to-be-heated portion of a base component in an induction coil and performing induction heating to form a heated portion, wherein the induction heating is gradient heating, a first heating temperature and a second heating temperature are formed in a cross-section of the to-be-heated portion of the base component wherein during the induction heating the first heating temperature is equal to a component quenching temperature +50° C., and the second heating temperature is equal to the component quenching temperature ±10° C. wherein the first heating temperature is the maximum temperature during the gradient heating, and the second heating temperature is the minimum temperature during the gradient heating;

S2: after a completion of the induction heating, spraying a quenching solution on the heated portion, cooling the heated portion down to room temperature, removing the base component from the induction coil, and tempering the base component at a temperature of 100° C. to 250° C. to obtain a quenched component wherein the quenching solution comprises substances including: modified polyalkylene glycol PAG) copolymer, triethanolamine, monoethanolamine, calcium chloride, sorbitan monooleate, and deionized water in a mass ratio of 30 to 35):(0.3 to 0.4):(0.05 to 0.1:(2.5 to 3.5):1 to 3):(35 to 40); and S3: grinding, degreasing, and drying a hardened portion of the quenched component, coating a surface treatment solution on a surface of the hardened portion, curing the surface treatment solution, and performing an induction cladding on the hardened portion in a nitrogen atmosphere to obtain the locally hardened component.

2. The method of claim 1, wherein:

in S2, a water pressure for spraying the quenching solution is in a range of 100 to 120 kPa, and a water flow density is in a range of 70 to 80 $L \cdot m^{-2}s^{-1}$.

3. The method of claim 1, wherein:

in S3, a coating thickness of the surface treatment solution is in a range of 0.5 to 0.7 mm.

4. The method of claim 1, wherein:

in S3, a temperature for curing the surface treatment solution is in a range of 140 to 150° C., and a time for curing the surface treatment solution is in a range of 5 to 10 min.

5. The method of claim 1, wherein:

in S3, the induction cladding is operated at a current of 1150 to 1250 A, a power of 25 kW, an oscillation frequency in a range of 50 to 80 kHz, a coil turn count of 4, and a time of 40 to 50 s.

6. The method of claim 1, wherein the modified PAG copolymer is prepared by:

(1) obtaining a polymerized monomer by mixing ethylene oxide, propylene oxide, and glycidic acid at a temperature of 3 to 5° C.;

(2) under the nitrogen atmosphere, adding propylene glycol and catalyst to a reactor, and heating to 75 to 85° C. under a vacuum degree≤−0.09 MPa, after which the polymerized monomer is gradually introduced to ensure that a pressure is 0.3 MPa, carrying out a reaction at 125 to 135° C. for 8 to 10 h, and obtaining a PAG copolymer after purification; and (3) adding the PAG copolymer to deionized water and mixing, adding chitosan and an activator, stirring at 80 to 85° C. for 5 to 6 h, and obtaining the modified PAG copolymer after purification and drying.

7. The method of claim 1, wherein the surface treatment solution is prepared by:

(1) adding sodium polymethacrylate to deionized water and mixing, adding dopamine and an activator, adjusting pH to 7.5 to 8.5, heating and stirring at 70 to 80° C. for 5 to 7 h, and obtaining modified polymethacrylic acid after liquid separation and washing;

(2) obtaining metal powder by mixing nano titanium carbide, tungsten powder, and nickel powder; and (3) mixing the metal powder, the modified polymethacrylic acid, ethyl cellulose, and acetone, and shear stirring at 40 to 45° C. for 1 to 1.5 h to obtain the surface treatment solution.

8. The method of claim 6, wherein:

the polymerized monomer comprises the ethylene oxide, the propylene oxide, and the glycidic acid in a mass ratio of 10:(13 to 14):(3 to 5);

a mass ratio of the propylene glycol and the catalyst is (5 to 7):1;

a mass ratio of the polymerized monomer and the catalyst is 100:(0.5 to 0.7); and the modified PAG copolymer comprises raw materials including: the PAG copolymer, the deionized water, the chitosan, the activator in a mass ratio of (8 to 10):(40 to 50):(3 to 5):(3 to 4).

9. The method of claim 8, wherein the catalyst comprises a diimine iron complex and potassium hydroxide in a mass ratio of 1:3.5.

10. The method of claim 7, wherein the modified polymethacrylic acid comprises:

the sodium polymethacrylate, the dopamine, and the activator in a mass ratio of (4 to 5):(14 to 16):(7 to 8).

11. The method of claim 7, wherein the sodium polymethacrylate has a molecular weight of 3000 to 4000.

12. The method of claim 7, wherein the activator comprises 1-(3-dimethylaminopropyl)-3-ethylcarbodiimide and succinimide in a mass ratio of 1:1 to 3.

13. The method of claim 7, wherein the metal powder comprises the nano titanium carbide, the tungsten powder, the nickel powder in a mass ratio of 2:(3 to 4):(5 to 6).

14. The method of claim 7, wherein the tungsten powder and the nickel powder have a particle size of 1-4 μm.

15. The method of claim 7, wherein the surface treatment solution comprises the metal powder, the modified polymethacrylic acid, the ethyl cellulose, and the acetone in a mass ratio of 3:(1 to 2):(2.5 to 3.5):(24 to 26).

* * * * *